US005336593A

United States Patent [19]

Daifuku et al.

[11] Patent Number: 5,336,593

[45] Date of Patent: Aug. 9, 1994

[54] SILVER HALIDE COLOR PHOTOGRAPHIC MATERIALS

[75] Inventors: Koji Daifuku; Hiroshi Kita; Yutaka Kaneko, all of Hino, Japan

[73] Assignee: Konica Corporation, Tokyo, Japan

[21] Appl. No.: 85,192

[22] Filed: Jul. 2, 1993

[30] Foreign Application Priority Data

Jul. 6, 1992 [JP] Japan ..... 4-202021

[51] Int. Cl.[5] ..... G03C 7/38

[52] U.S. Cl. ..... 430/558; 430/386; 430/387

[58] Field of Search ..... 430/558, 386, 387

[56] References Cited

U.S. PATENT DOCUMENTS 3,725,067 4/1973 Bailey et al. ..... 96/56.5
4,839,264 6/1987 Kida et al. ..... 430/558
5,118,599 6/1992 Lau et al. ..... 430/556

FOREIGN PATENT DOCUMENTS 3101848 5/1988 Japan ..... 430/558

*Primary Examiner*—Lee C. Wright

*Attorney, Agent, or Firm*—Finnegan, Henderson, Farabow, Garrett & Dunner

[57] ABSTRACT

The improved silver halide color photographic material contains at least one pyrazolotriazole base magenta coupler represented by the following general formula [Ia] or [Ib]:

[Ia]

[Ib]

This photographic material is improved in image keeping quality, especially in lightfastness, without lowering the efficiency of color formation and it also insures good color reproduction.

7 Claims, No Drawings

SILVER HALIDE COLOR PHOTOGRAPHIC MATERIALS

BACKGROUND OF THE INVENTION

The present invention relates to silver halide color photographic materials that are improved in image keeping quality and color reproduction.

Color print papers and other color photographic materials that are intended for direct viewing have conventionally adopted the combinations of yellow, magenta and cyan couplers for the purpose of forming color dye images. Extensive efforts have been made in order to improve the lightfastness of color dye images produced from these couplers so that they can be stored for use over many years.

However, the results of these efforts are not completely satisfactory in meeting the user's demand for preventing the fading or discoloration of dye images in color photography so that he can store image of high quality for an almost indefinite period. As for the keeping quality of images in the dark such as on albums, significant improvements have recently been accomplished in the art as typically exemplified by "Konica Color 100-Year Print", thus making it possible to store photographic images for an acceptable long period. On the other hand, the lightfastness of images, namely, their keeping quality under exposure to light, is still unsatisfactory and needs further improvements. In particular, magenta dyes have lower lightfastness than yellow and cyan dyes and considerable efforts for improvement have been made.

Recently developed pyrazoloazole base magenta couplers are characteristically different from the heretofore used 5-pyrazolone base magenta couplers in that the color dyes do not have an unwanted absorption at wavelengths near 430 nm and that, hence, they are essentially advantageous from the viewpoint of color reproduction. However, it is known that magenta dyes produced from pyrazoloazole base magenta couplers have lower lightfastness than those produced from 5-pyrazolone base magenta couplers, and many techniques for improvement have so far been proposed. To name a few, Japanese Laid-Open Patent Application (kokai) Nos. Sho 56-159644, 59-125732, 61-145552, 60-262159, 61-90155 and Hei 3-39956 proposed the use of phenolic or phenylether base compounds; Japanese Laid-Open Patent Application (kokai) Nos. Sho 61-73152, 61-72246, 61-189539, 61-189540 and 63-95439 proposed the use of amine base compounds; Japanese Laid-Open Patent Application (kokai) Nos. Sho 61-140941, 61-145554, 61-158329 and 62-183459 proposed the use of metal complexes; and Japanese Laid-Open Patent Application (kokai) No. Hei 2-100048 proposed the use of inclusion compounds or hetero cyclic compounds. However, when these compounds are put to actual use, various problems can take place, as exemplified by a drop in the color densities of couplers, the occurrence of color staining during prolonged storage, color contamination due to coloring by the added compounds per se, unwanted changes in color, and deterioration in the dispersibility and time-dependent stability of coupler-containing dispersions. The techniques described above have proved to be very effective in improving the lightfastness of magenta dyes but the state of the art is such that the thus improved lightfastness of magenta dyes is still poor compared to that of yellow and cyan dyes and, in the fading process, the color balance of image is upset and the color of the actual picture shifts toward the yellow or cyan side, thereby causing quite unnatural changes in color. As another approach, a branched alkyl group having great steric hindrance can be substituted on the pyrazolotriazole skeleton with a view to improving the lightfastness of the magenta dye and this idea is taught in Japanese Laid-Open Patent Application (kokai) No. Sho 61-65245. This technique is effective in providing improved lightfastness but, at the same time, new problems arise such as the broad absorption of light by the resulting dye and the drop in the efficiency of color formation. Hence, the development of a more effective approach is strongly needed for the particular purpose of improving the lightfastness of magenta dye images.

SUMMARY OF THE INVENTION

The present invention has been accomplished under these circumstances and has as an object providing a silver halide color photographic material that is improved in image keeping quality since it produces better lightfastness in dye images without lowering the efficiency of color formation;

Another object of the present invention is to provide a silver halide color photographic material capable of satisfactory color reproduction.

These objects of the present invention can be attained by a silver halide color photographic material that contains at least one pyrazolotriazole base magenta coupler represented by the general formula [Ia] or [Ib] set forth below (which coupler is hereunder referred to as the "magenta coupler of the present invention"). The objects can also be attained by a silver halide color photographic material that contains at least one compound represented by the following general formula [II] or [III] in a silver halide emulsion layer that contains the magenta coupler of the present invention :

[Ia]

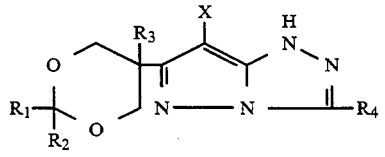

[Ib]

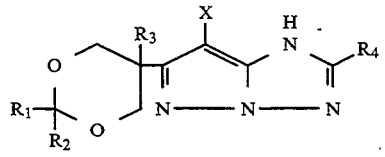

where $R_1$, $R_2$ and $R_3$ are each a hydrogen atom, an alkyl group, a cycloalkyl group or an aryl group; $R_4$ is an aliphatic or aromatic group each of which may optionally have a substituent; X is a hydrogen atom, a chlorine atom, a bromine atom, a fluorine atom, an alkoxy group, an aryloxy group, a heterocycloxy group, an alkylthio group, an arylthio group, a heterocyclothio group, an amino group, an acylamino group, a sulfonamido group or a nitrogenous heterocyclic group bound to the pyrazolotriazole nucleus by a nitrogen atom of the heterocyclic group;

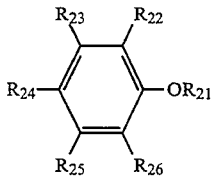

[II]

where $R_{21}$ is a hydrogen atom, an alkyl group, an aryl group, a heterocyclic group or the following residue:

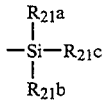

(where $R_{21}a$, $R_{21}b$ and $R_{21}c$ are each a monovalent organic group); $R_{22}$, $R_{23}$, $R_{24}$, $R_{25}$ and $R_{26}$ are each a hydrogen atom, a halogen atom or a group that can be substituted on the benzene ring, provided that $R_{21}$–$R_{26}$ may combine together to form a 5- or 6-membered ring;

[III]

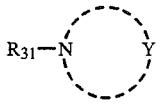

where $R_{31}$ is an aliphatic or aromatic group; and Y is the nonmetallic atomic group necessary to form a 5- to 7-membered ring together with the nitrogen atom.

DETAILED DESCRIPTION OF THE INVENTION

The present invention is described below in greater detail.

With reference to the general formulae [Ia] and [Ib], each of $R_1$ and $R_2$ represents a hydrogen atom, a straight-chained or branched alkyl group (e.g. methyl, ethyl, i-propyl, t-butyl, n-dodecyl or 1-hexylnonyl), a cycloalkyl group (e.g. cyclopropyl, cyclohexyl, bicycol[2.2.1]heptyl or adamantyl), or an aryl group (e.g. phenyl, 1-naphthyl or 9-anthranyl). The alkyl, cycloalkyl and aryl groups represented by $R_1$ and $R_2$ may have substituents that have the same meanings as the alkyl, cycloalkyl and aryl groups which are represented by $R_1$ and $R_2$. Other examples of the substituents that can be used include: a halogen substituted alkyl group (e.g. trifluoromethyl), a halogen atom (e.g. Cl or Br), a cyano group, a nitro group, an alkenyl group (e.g. 2-propylene or oleyl), a hydroxy group, an alkoxy group (e.g. methoxy or 2-ethoxyethoxy), an aryloxy group (e.g. phenoxy, 2,4-di-t-amylphenoxy or 4-(4-hydroxyphenylsulfonyl)phenoxy), a heterocycloxy group (e.g. 4-pyridyloxy or 2-hexahydropyranyloxy), a carbonyloxy group (e.g. alkylcarbonyloxy such as acetyloxy, trifluoroacetyloxy or pivaloyloxy, or aryloxy such as benzoyloxy or pentafluorobenzoyloxy), a sulfonyloxy group (e.g. alkylsulfonyloxy such as methanesulfonyloxy, trifluoromethanesulfonyloxy or n-dodecanesulfonyloxy, or arylsulfonyloxy such as benzenesulfonyloxy or p-toluenesulfonyloxy), a carbonyl group (e.g. alkylcarbonyl such as acetyl or trifluoroacetylpivaloyl, or arylcarbonyl such as benzoyl, pentafluorobenzoyl or 3,5-di-t-butyl-4-hydroxybenzoyl), an oxycarbonyl group (e.g. alkoxycarbonyl such as methoxycarbonyl, cyclohexyloxycarbonyl or n-dodecyloxycarbonyl, aryloxycarbonyl such as phenoxycarbonyl, 2,4-di-t-amylphenoxycarbonyl or 1-naphthyloxycarbonyl, or heterocyclooxycarbonyl such as 2-pyridyloxycarbonyl or 1-phenylpyrazolyl-5-oxycarbonyl), a carbamoyl group (e.g. alkylcarbamoyl such as dimethylcarbamoyl or 4-(2,4-di-t-amylphenoxy)-butylaminocarbonyl, or arylcarbamoyl such as phenylcarbamoyl or 1-naphthylcarbamoyl), a sulfonyl group (e.g. alkylsulfonyl such as methanesulfonyl or trifluoromethanesulfonyl, or arylsulfonyl such as p-toluenesulfonyl), a sulfamoyl group (e.g. alkylsulfamoyl such as dimethylsulfamoyl or 4-(2,4-di-t-amylphenoxy)-butylaminosulfonyl, or arylsulfamoyl such as phenylsulfamoyl), an amino group (e.g. alkylamino such as dimethylamino, cyclohexylamino or n-dodecylamino, or arylamino such as anilino or p-t-octylanilino), a sulfonylamino group (e.g. alkylsulfonylamino such as methanesulfonylamino, heptafluoropropanesulfonylamino or n-hexadecylsulfonylamino, or arylsulfonylamino such as p-toluenesulfonyl or pentafluorobenzenesulfonylamino), an acylamino group (e.g. alkylcarbonylamino such as acetylamino or myristoylamino, or arylcarbonylamino such as benzoylamino), an alkylthio group (e.g. methylthio or t-octylthio), an arylthio group (e.g. phenylthio), and a heterocyclothio group (e.g. 1-phenyltetrazole-5-thio or 5-methyl-1,3,4-oxadiazole-2-thio).

Preferred examples of $R_1$ and $R_2$ are each a hydrogen atom, an alkyl group having 1–20 carbon atoms, a cycloalkyl group, as well as a substituted or uhnsubstituted aryl group having 6–30 carbon atoms.

With reference to the general formulae [Ia] and [Ib], $R_3$ represents groups having the same meanings as the alkyl, cycloalkyl and aryl groups which are represented by $R_1$ and $R_2$. The alkyl, cycloalkyl and aryl groups represented by $R_3$ may have substituents and exemplary substituents have the same meanings as those which are listed as substituents on the alkyl, cycloalkyl and aryl groups which are represented by $R_1$ and $R_2$ in the general formulae [Ia] and [Ib].

Preferred examples of $R_3$ are an alkyl group having 1–20 carbon atoms, as well as a substituted or unsubstituted aryl group having 6–30 carbon atoms.

The aliphatic group represented by $R_4$ may be straight-chained or branched or cyclic and it may be saturated or unsaturated. This aliphatic group may have substituents that are exemplified by, but by no means limited to, aryl, anilino, acylamino, sulfonamido, alkylthio, arylthio, alkenyl and cycloalkyl groups. Other examples of the substituents that can be used include: a halogen atom; groups such as cycloalkenyl, alkynyl, heterocyclic, sulfonyl, sulfinyl, phosphonyl, acyl, carbamoyl, sulfamoyl, cyano, alkoxy, heterocycloxy, siloxy, acyloxy, carbamoyloxy, amino, alkylamino, imido, ureido, sulfamoylamino, alkoxycarbonylamino, aryloxycarbonylamino, alkoxycarbonyl, aryloxycarbonyl, hydroxy, carboxy and heterocyclothio groups; and residues such as those of a spiro compound and a bridged hydrocarbon compound.

A preferred aryl group is phenyl.

Preferred acylamino groups are alkylcarbonylamino and arylcarbonylamino.

Preferred sulfonamido groups are alkylsulfonylamino and arylsulfonylamino.

the alkyl moiety of an alkylthio group may be straight-chained or branched or cyclic, or it may optionally have substituents such as methyl, ethyl, isopropyl, t-butyl, neopentyl, chloromethyl and methoxymethyl groups. Examples of the aryl moiety of an arylthio group include phenyl, 1-naphthyl and 2-naphthyl groups, and these may optionally have substituents such as 2-chlorophenyl and 4-methoxyphenyl.

Preferred alkenyl groups are those which have 2–32 carbon atoms, and preferred cycloalkyl groups are those which have 3–12 carbon atoms, with those having 5–7 carbon atoms being particularly preferred. The alkenyl group may be straight-chained or branched.

Preferred cycloalkenyl groups are those which have 3–12 carbon atoms, with those having 5–7 carbon atoms being particularly preferred.

Preferred sulfonyl groups are alkylsulfonyl and arylsulfonyl.

Preferred sulfinyl groups are alkylsulfinyl and arylsulfinyl.

Preferred phosphonyl groups are alkylphosphonyl, alkoxyphosphonyl, aryloxy phosphonyl and arylphosphonyl.

Preferred acyl groups are alkylcarbonyl and arylcarbonyl.

Preferred carbamoyl groups are alkylcarbamoyl and arylcarbamoyl.

Preferred sulfamoyl groups are alkylsulfamoyl and arylsulfamoyl.

Preferred acyloxy groups are alkylcarbonyloxy and arylcarbonyloxy.

Preferred carbamoyloxy groups are alkylcarbamoyloxy and arylcarbamoyloxy.

Preferred ureido groups are alkylureido and arylureido.

Preferred sulfamoylamino groups are alkylsulfamoylamino and arylsulfamoylamino.

Preferred heterocyclic groups are those which are 5- to 7-membered and typical examples are 2-furyl, 2-thienyl, 2-pyrimidinyl and 2-benzothiazolyl.

Preferred heterocycloxy groups are those which have 5- to 7-membered hetero rings, as exemplified by 3,4,5,6-tetrahydropyranyl-2-oxy and 1-phenyltetrazol-5-oxy.

Preferred heterocyclothio groups are those which are 5- to 7-membered, as exemplified by 2-pyridylthio, 2-benzothiazolylthio, and 2,4-diphenoxy-1,3,5-triazole-6-thio.

Preferred siloxy groups are trimethylsiloxy, triethylsiloxy and dimethylbutylsiloxy.

Preferred imido groups are succinimido, 3-heptadecylsuccinimido, phthalimido and glutarimido.

A preferred spiro compound residue is spiro [3.3]heptan-1-yl.

Preferred examples of the residue of a bridged hydrocarbon compound include bicyclo[2.2.1]heptan-1-yl, tricyclo[3.3.1.1$^{37}$]decan-1-yl, and 7,7-dimethylbicyclo[2.2.1]heptan-1-yl.

Preferred examples of the aliphatic group represented by $R_4$ are those which have a total of 4–42 carbon atoms and which are branched.

Examples of the aromatic group represented by $R_4$ include phenyl, 1-naphthyl and 2-naphthyl, with the phenyl being preferred. These aromatic groups may have substituents and typical examples of the substituents that can be used include those which are already listed as substituents on the aliphatic groups.

Examples of the alkoxy group represented by X include methoxy, isopropyloxy and cyclohexyloxy.

Exemplary aryloxy groups include phenoxy, 2-nitrophenoxy and 1-naphthyloxy.

Exemplary heterocycloxy groups include 3-pyridyloxy and 2-pyrazolyloxy.

Exemplary alkylthio groups include n-octylthio and 3-carboxyethylthio.

Exemplary arylthio groups include p-tolylthio and 2-butoxyphenylthio.

Exemplary heterocyclothio groups include 1-phenyl-5-tetrazolylthio and 2-pyridylthio.

Exemplary amino groups include dipropylamino, morpholino and pyrrolidinyl.

Exemplary acylamino groups include acetylamino and benzoylamino.

Exemplary sulfonamido groups include methanesulfonamido and p-toluenesulfonamido.

Examples of the nitrogenous hetero ring bound with nitrogen atoms include 1-imidazolyl, 1-pyrazolyl and 2-benzotriazolyl.

Among the substituents listed above as X, a chlorine atom is particularly preferred.

The magenta coupler of the present invention is typically exemplified by, but by no means limited to, the following compounds.

1

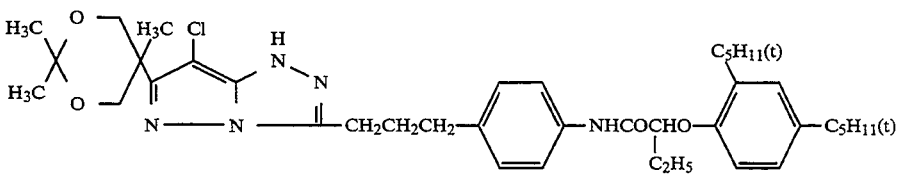

2

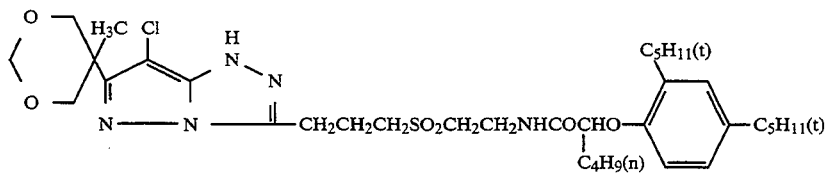

-continued
3
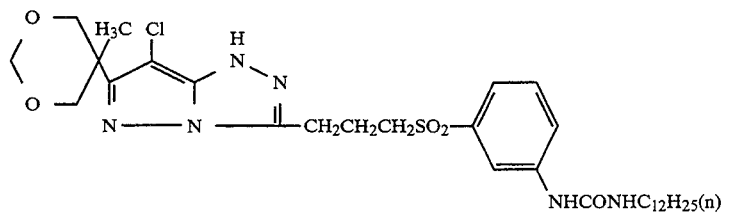
4
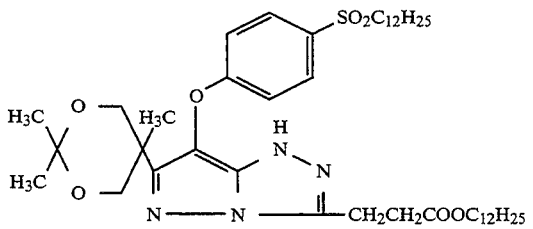
5
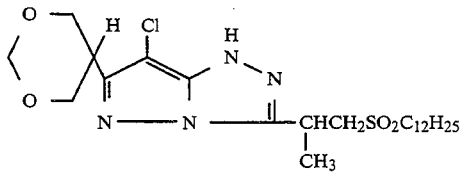
6
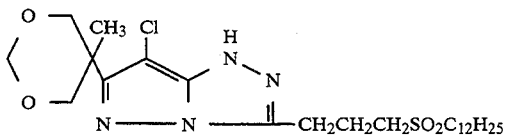
7
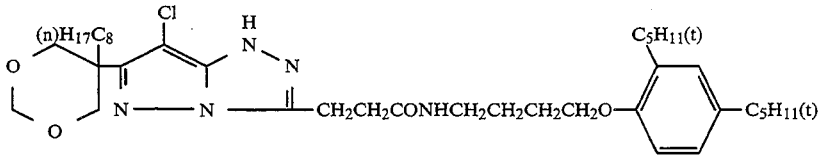
8
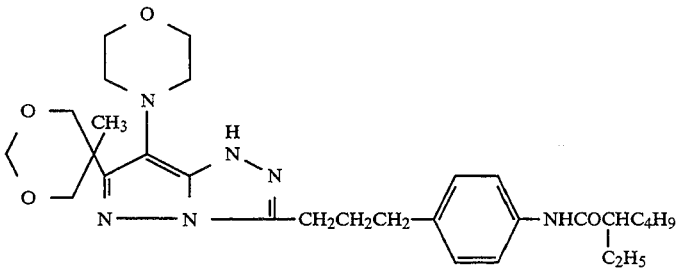
9
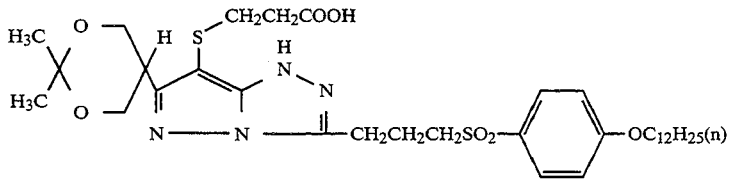
10
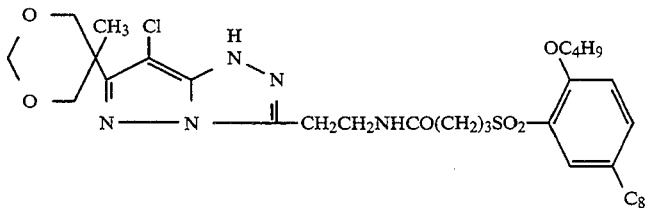

-continued
11
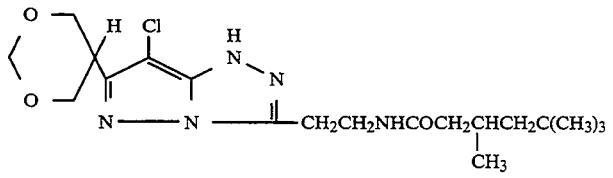
12
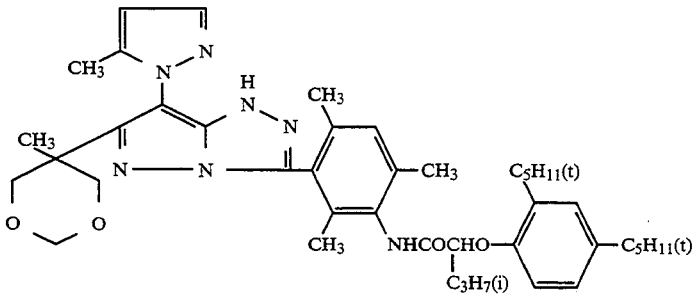
13
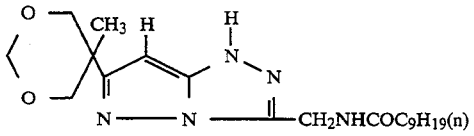
14
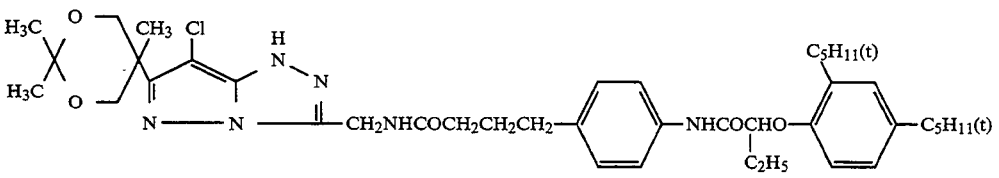
15
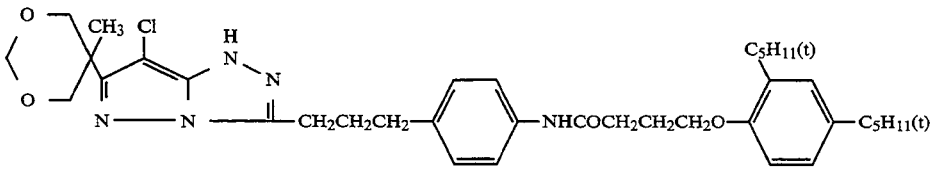
16
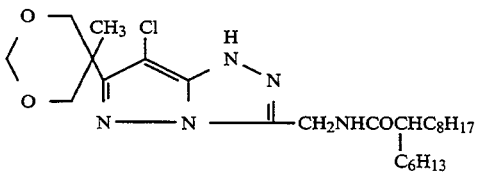
17
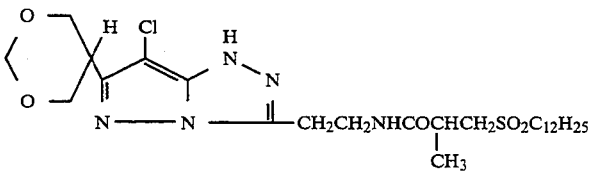
18
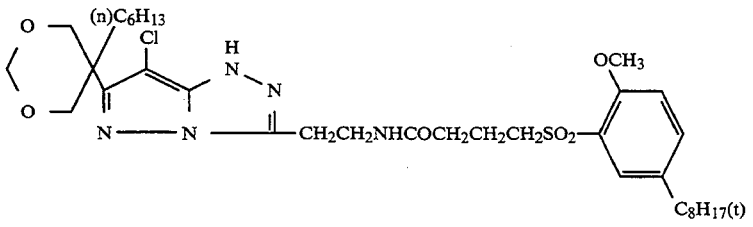

-continued
19
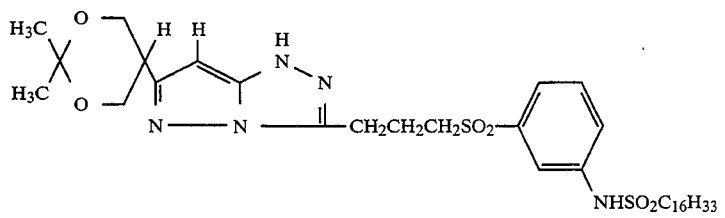
20
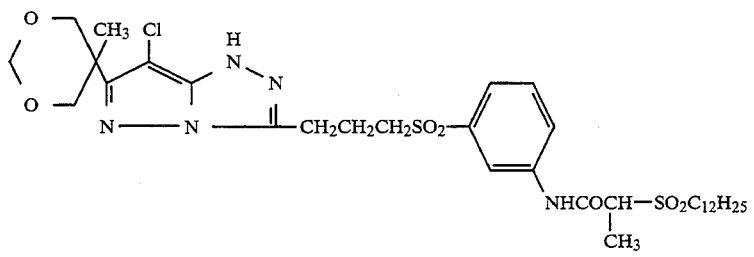
21
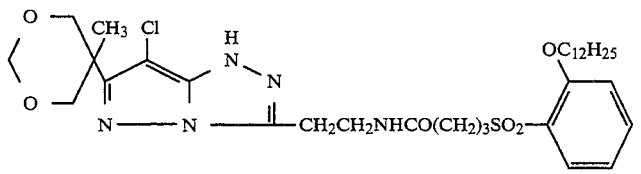
22
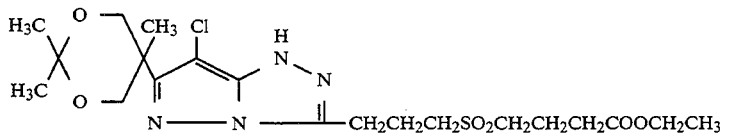
23
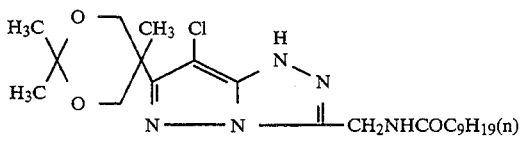
24
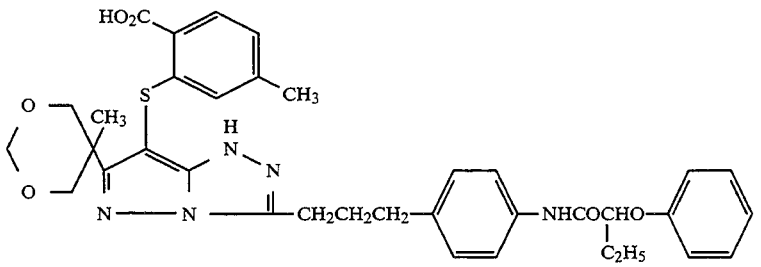
25
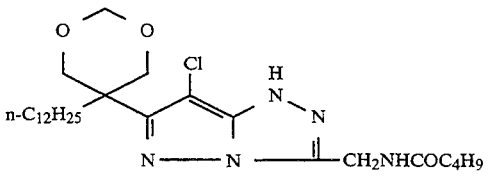

-continued
26
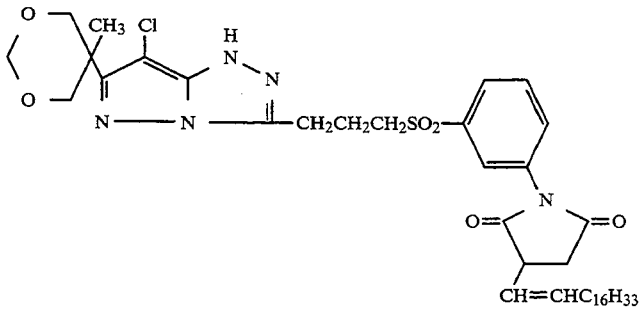
27
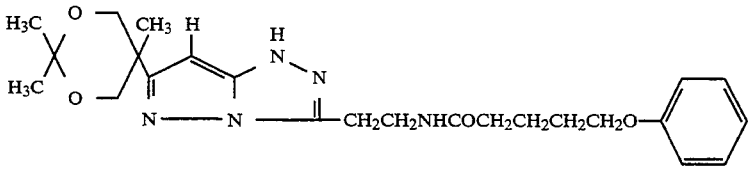
28
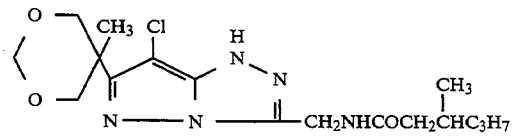
29
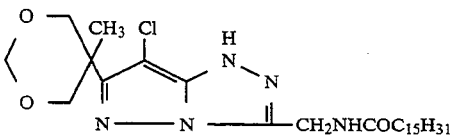
30
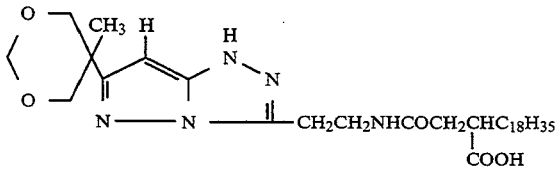
31
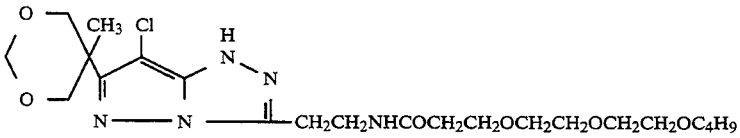
32
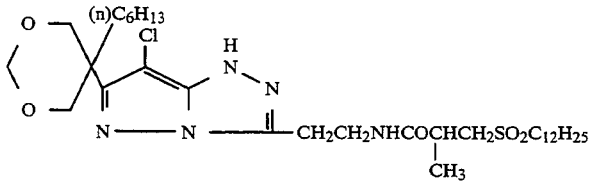
33
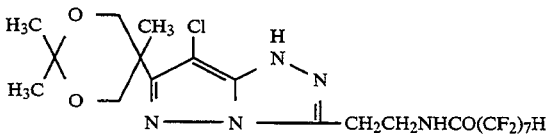
34
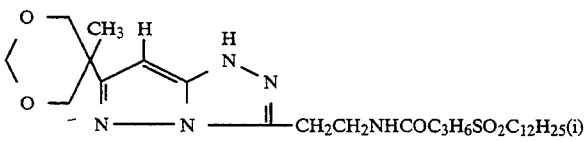

-continued

35

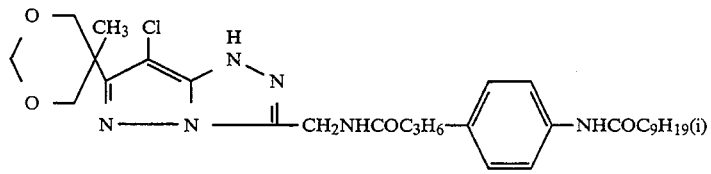

36

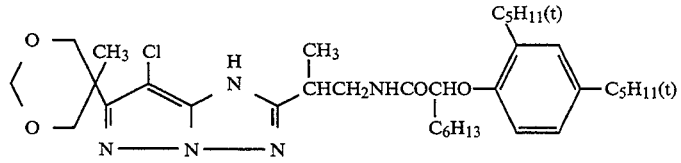

37

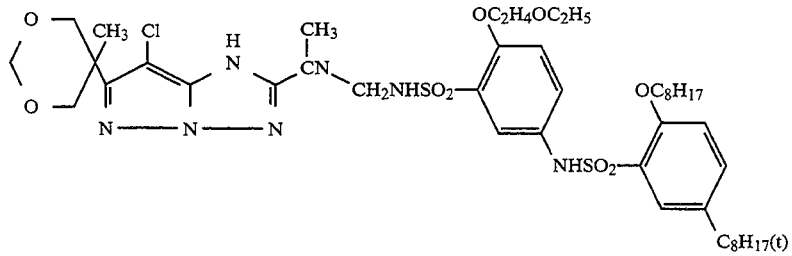

38

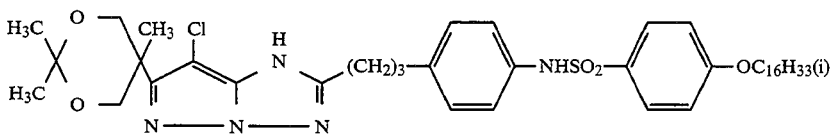

The above listed pyrazoloazole base magenta couplers of the present invention, namely, the compounds represented by the general formulae [Ia] or [Ib], can be easily synthesized by one skilled in the art with reference being made to the disclosure in Journal of the Chemical Society, Perkin; I (1977), 2047-2052, U.S. Pat. No. 3,725,067, and Japanese Laid-Open Patent Application (kokai) Nos. Sho 59-99439, 59-171956, 60-43659 and 60-172982.

An example of the method of synthesizing one of the compounds listed above is described below.

SYNTHESIS OF EXEMPLARY COMPOUND 6

I) Synthesis route

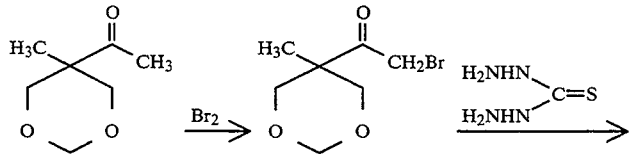

Intermediate 1 described in U.S. Pat. No. 5,118,599

Intermediate 2

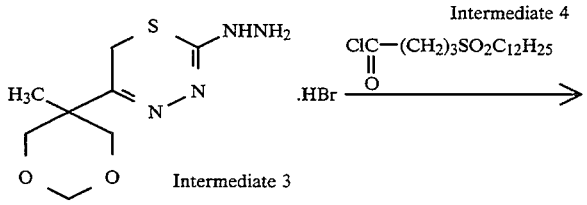

Intermediate 3

Intermediate 4

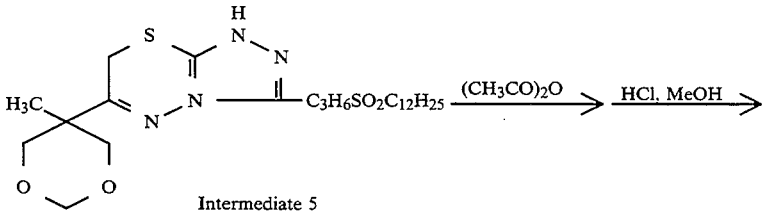

Intermediate 5

-continued

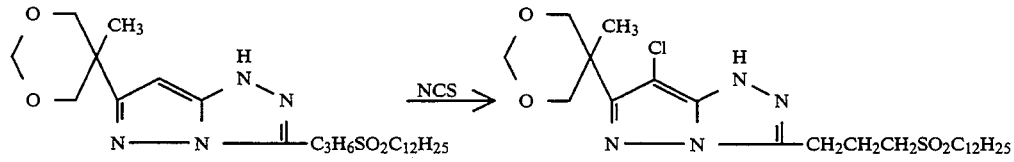

Intermediate 6 Exemplary compound 6

II) Synthesis of intermediate 2

Intermediate 1 (14.4 g; the compound described in the specification of U.S. Pat. No. 5,118,599) and diethyl ether (150 ml) are cooled to 0° C. on an ice bath and bromine (15.9 g) is added dropwise over a period of 30 min. After the end of dripping, the ice bath is taken away and the mixture is stirred for 1.5 h. Ice (100 g) and water (100 ml) are added to the reaction solution and the ether layer is separated by means of a separating funnel. After washing with 200 ml of ice water three times, the ether layer is dried with anhydrous sodium sulfate and concentrated under vacuum to yield a yellow liquid material, which is isolated by column chromatography to produce a colorless amorphous intermediate 2 in an amount of 15.2 g (yield, 68.4%). (Identification made by 1H NMR, IR and FD mass spectra.)

III) Synthesis of intermediate 3

Intermediate 2 (11.6 g) and thiocarbohydride (5.3 g) as dissolved in ethyl alcohol (80 ml) are heated under reflux for 2 h with stirring (until solids are deposited slowly). The reaction solution is cooled and filtered, followed by washing with cold ethyl alcohol to produce the desired intermediate 3 (white solids) in an amount of 11.3 g (yield, 70.1%). (Identification made by 1H NMR, IR and FD mass spectra.)

IV) Synthesis of intermediate 5

Acetonitrile (150 ml) is added to 9.3 g of intermediate 3. To the mixture, 12.2 g of acid chloride intermediate 4 is added and the resulting mixture is heated under reflux for 6 h with stirring. The insoluble matter is removed by filtration while it is hot and the filtrate is concentrated under vacuum to yield a yellow solid material, which is recrystallized with methanol to produce intermediate 5 (pale yellow solids) in an amount of 10.2 g (yield, 70.5%). (Identification made by 1H NMR, IR and FD mass spectra).

V) Synthesis of intermediate 6

Acetic anhdride (55 ml) is added to 9.7 g of intermediate 5 and the mixture is heated under reflux for 3 h. Excess acetic anhydride is distilled off (ca. 40 ml) under atmospheric pressure and, thereafter, the reaction solution is cooled to room temperature. To the cooled solution, methanol (100 ml) and conc. HCl (10 ml) are added and the mixture is heated under reflux for 3 h, whereupon sulfur is deposited.

The deposited sulfur is recovered by filtration and, thereafter, methanol is distilled off under vacuum and the residue is extracted with ethyl acetate (150 ml), followed by neutralization with an aqueous solution of sodium hydroixe. Following washing with 100 ml of water three times, the reaction solution is dried with anhydrous magnesium sulfate and the solvent is distilled off under vacuum. The resulting solids are recrystallized with methanol to produce intermediate 6 (white solids) in an amount of 6.0 g (yield, 68.2%). (Identification made by 1H NMR, IR and FD mass spectra.)

VI) Synthesis of exemplary compound 6

Intermediate 6 (6.0 g) is dissolved in chloroform (75 ml) and the solution is cooled to 5° C. on an ice bath. To the cooled solution, 1.8 g of N-chlorosuccinimide (NCS) is added over a period of about 1 h. Thereafter, reaction is carried out for 2 h so that intermediate 6 undergoes thorough reaction. The reaction solution is washed with aqueous NaCl solution (100 ml) twice, dried with anhydrous magnesium sulfate and distilled off under vacuum to yield pale yellow solids. Upon recrystallization with methanol, the desired exemplary compound 6 (white crystal) is produced in an amount of 5.7 g (yield, 88.5%). The structure of the compound is verified by 1H NMR, IR and FD mass spectra.

In a preferred embodiment of the present invention, at least one compound represented by the general formulae [II] and [III] is contained in an silver halide emulsion layer containing the magenta coupler of the present invention.

With reference to the general formula [II], the alkyl and aryl groups represented by $R_{21}$ may be the same as those which are exemplified as the alkyl and aryl groups, respectively, that are represented by $R_1$ in the general formulae [Ia] and [Ib]. The hetero ring represented by $R_{21}$ is preferably 5- to 7-membered, as specifically exemplified by 2-furyl, 2-ethynyl, 2-pyrimidinyl and 2-benzothiazolyl. Examples of the monovalent organic group represented by each of $R_{21}a$, $R_{21}b$ and $R_{21}c$ include alkyl, aryl, alkoxy, aryloxy and halogen atom. Preferred examples of $R_{21}$ are a hydrogen atom and an alkyl group. Examples of the group that can be attached as a substituent on the benzene ring and which is represented by each or $R_{22}$–$R_{26}$ are those which are listed as examples of the substituent represented by $R_1$ in the general formulae [Ia] and [Ib]. Preferred examples of each of $R_{22}$, $R_{23}$, $R_{25}$ and $R_{26}$ are a hydrogen atom, a hydroxy group, an alkyl group, an aryl group, an alkoxy group, an aryloxy group and an acyl group; preferred examples of $R_{24}$ are an alkyl group, a hydroxy group, an aryl group, an alkoxy group and an aryloxy group. If desired, $R_{21}$ and $R_{22}$ may combine together to form a 5- or 6-membered ring, provided that $R_{24}$ is preferably a hydroxy, alkoxy or aryloxy group. In a certain case, $R_{21}$ and $R_{22}$ may combine together to form a methylenedioxy group. Furthermore, $R_{23}$ and $R_{24}$ may combine together to form a 5-membered hydrocarbon ring, provided that $R_{21}$ is preferably an alkyl, aryl or heterocyclic group.

Specific but by no means limiting examples of the compound represented by the general formula [II] are listed below.

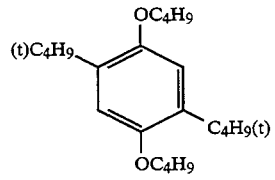

II-1

-continued

II-2

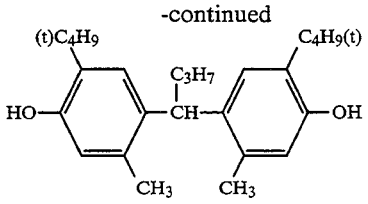

II-3

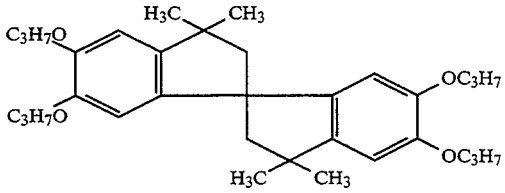

II-4

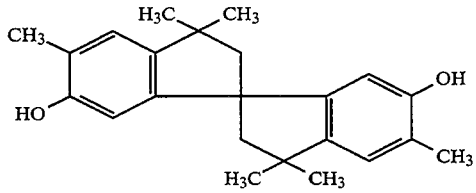

II-5

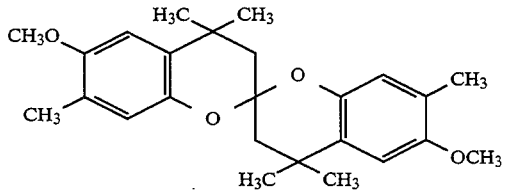

II-6

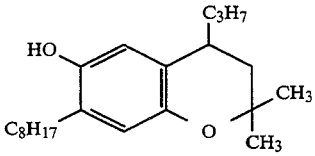

II-7

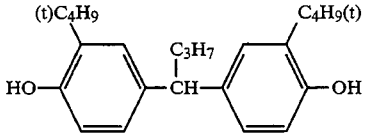

II-8

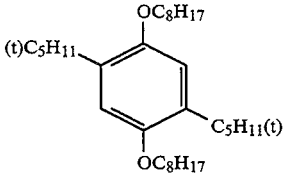

Besides the compounds set forth above, specific examples of the compound represented by the general formula [II] include Exemplary Compounds A-1 to A-28 listed on pages 11–13 of the specification of Japanese Laid-Open Patent Application (kokai) No. Sho 60-262159, Exemplary Compounds PH-1 to PH-29 listed on pages 8–10 of the specification of Japanese Laid-Open Patent Application (kokai) No. Sho 61-145552, Exemplary Compounds B-1 to B-21 listed on pages 6 and 7 of the specification of Japanese Laid-Open Patent Application (kokai) No. Hei 1-306846, Exemplary Compounds I-1 to I-13, I'-1 to I'-8, II-1 to II-12, II'-1 to II'-21, III-8 to III-14, IV-1 to IV-24 and V-13 to V-17, and Exemplary Compounds II-1 to II-33 listed on pages 10–18 of the specification of Japanese Laid-Open Patent Application (kokai) No. Hei 2-958, and Exemplary Compounds II-1 to II-33 listed on pages 10 and 11 of the specification of Japanese Laid-Open Patent Application (kokai) No. Hei 3-39956.

Now with reference to the general formula [III], $R_{31}$ represents an aliphatic or aromatic group, preferably an alkyl group, an aryl group or a heterocyclic group, with the aryl group being most preferred. Examples of the hetero ring which is formed by Y together with the nitrogen atom include a piperidine ring, a piperazine ring, a morpholine ring, a thiomorpholine ring, thiomorpholine-1, 1-dione ring, and a pyrrolidine ring.

Specific examples of the compound represented by the general formula [III] are listed below.

III-1

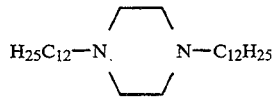

III-2

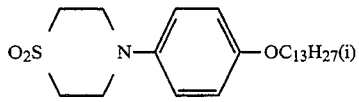

III-3

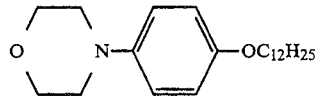

III-4

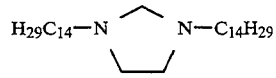

III-5

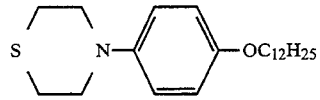

III-6

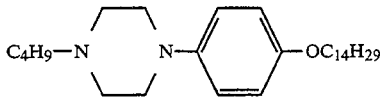

Besides the compounds set forth above, specific examples of the compounds represented by the general formula [III] include Exemplary Compounds B-1 to B-65 listed on pages 8–11 of the specification of Japanese Laid-Open Patent Application (kokai) No. Hei 2-167543, and Exemplary Compounds (1)–(120) listed on pages 4–7 of Japanese Laid-Open Patent Application (kokai) No. Sho 63-95439.

The compound represented by the general formula [II] or [III] is preferably added in an amount of 5–500 mol %, more preferably 20–200 mol %, of the magenta coupler of the present invention. Two or more of the compounds represented by the general formula [II] and/or [III] may be used if their total amount is within the specified ranges.

In accordance with the present invention, a metal chelate compound of the type described in Japanese Laid-Open Patent Application (kokai) Nos. Sho 61-158329, 62-183459, etc. may be used in the silver halide emulsion layer that contains the magenta coupler of the present invention and the compound represented by the general formula [II] or [III].

The magenta coupler of the present invention may be incorporated in emulsions by any of the known methods. For example, the magenta couplers of the present invention are dissolved, either independently or in admixture, in a high-boiling point organic solvent (b.p.≧175° C.) such as tricresyl phosphate or dibutyl phthalate or a low-boiling point solvent such as ethyl acetate or butyl propionate (which may be used either independently or, if necessary, admixed together) and the resulting solution is mixed with an aqueous gelatin solution containing a surfactant; thereafter, the mixture is emulsified with a high-speed rotary mixer or colloid mill, and the emulsified product is added to silver halides to prepare a silver halide emulsion that is to be used in the present invention.

The magenta coupler of the present invention is used typically in an amount of $1\times10^{-3}-1$ mole, preferably $1\times10^{-2}-8\times10^{-1}$ mole, per mole of silver halide.

The magenta coupler of the present invention may be used in combination with conventional magenta couplers.

The silver halide composition that is preferably used in the silver halide color photographic material of the present invention is exemplified by silver chloride, silver chlorobromide and silver chloroiodobromide. If desired, two or more silver halides may be combined, as in the case of silver chloride combined with silver bromide.

The silver halide emulsion to be used in the present invention may consist of any silver halides that are used in conventional silver halide emulsions, as exemplified by silver bromide, silver iodobromide, silver iodochloride, silver chlorobromide, silver chloroiodobromide and silver chloride.

The silver halide grains to be used in the present invention may have a uniform distribution of silver halide composition throughout the grain; alternatively, they may be core/shell grains having different silver halide compositions between the interior of grains and their surface layer.

The silver halide grains to be used in the present invention may be of such a type that a latent image is predominantly formed on the surface, or they may be of such a type that a latent image is predominantly formed in the interior.

The silver halide grains to be used in the present invention may have regular crystallographic shapes such as cubes, octahedra and tetradecahedra or they may have anomalous crystallographic shapes such as spheres and plates. These grains may have any values for the ratio of {100} to {111} faces.

The silver halide grains may consist of two or more of those crystallographic shapes combined together in composite forms, or grains of variously shaped crystals may be mixed together.

The silver halide grains are of a size that ranges preferably from 0.05 to 30 μm, more preferably from 0.1 to 20 μm.

The silver halide emulsions to be used in the present invention may have any grain size distributions. Emulsions having a broad grain size distribution (such emulsions are generally referred to as "polydispersed" emulsions) or, alternatively, emulsions having a narrow grain size distribution (such emulsions are generally referred to as "monodispersed" emulsions) may be used either independently or in admixture. If necessary, a polydispersed emulsion may be used in admixture with a monodispersed emulsion.

The couplers that can be used in the present invention include colored couplers which are capable of color correction, as well as those compounds which, upon coupling with the oxidation product of a developing agent, release photographically useful fragments such as a development retarder, a development accelerator, a bleach accelerator, a developer, a silver halide solvent, a toning agent, a hardener, a foggant, an antifoggant, a chemical sensitizer, a spectral sensitizer and a desensitizer. Among these compounds which release photographically useful fragments, so-called DIR compounds that release a development retarder as a function of development, thereby improving the sharpness or graininess of image may be used with particular advantage.

Such DIR compounds include two types: one that has a retarder connected directly at the coupling site, and the other that has a retarder connected tat the coupling site via a divalent group and which releases the retarder as a result intramolecular nucleophilic reaction or intramolecular electron transfer reaction that occur within the group that has been eliminated upon coupling reaction. The second type of DIR compounds are generally referred to as timing DIR compounds. There are also two types of retarder; one that is diffusible after elimination and the other being less diffusible. These retarders can be used either alone or in combination depending on the specific use.

Colorless couplers, also called "competing" couplers, that enter into a coupling reaction with the oxidation product of an aromatic primary amino developer but which will not form dyes may also be used in combination with dye-forming couplers.

Yellow couplers that are preferably used in the present invention include known acylacetanilide base couplers, among which benzoylacetanilide and pivaloylacetanilide base compounds can be used with advantage.

Cyan couplers that are preferably used in the present invention include phenolic and naphtholic couplers.

The oxidation product of a developing agent or an electron transfer agent may migrate between emulsion layers in a photographic material (i.e., between layers having sensitivity to the same color and/or between layers having sensitivity to different colors), whereby color contamination may occur, or sharpness may deteriorate or graininess may become noticeable. To avoid these problems, anti-color fog agents may be used.

Image stabilizers may be used in the photographic material of the present invention in order to prevent the deterioration of dye images. Compounds that can be used preferably for this purpose are described under J in Section VII or RD 17643.

The protective layer, intermediate layers and other hydrophilic colloidal layers in the photographic material of the present invention may contain an antifoggant to prevent discharge that would otherwise occur if the photographic material is electrified by friction, etc. The hydrophilic colloidal layers may also contain a uv inhibitor that will prevent image deterioration due to uv rays.

Formaldehyde scavengers may be used in the photographic material of the present invention in order to prevent deterioration of magenta dye forming couplers, etc. due to the action of formaldehyde during the storage of the photographic material.

The concept of the present invention is preferably applicable to color negative films, color papers, color reversal films, etc. Each of color negative films, color papers and color reversal films consists generally of blue-sensitive, green-sensitive and red-sensitive silver halide emulsion layers, as well as non-light-sensitive hydrophilic colloidal layers. The present invention is in no way limited in terms of the arrangement of those layers on a support.

To produce dye images with the photographic material of the present invention, it is subjected to color photographic processing after exposure. Color processing comprises the steps of color development, bleaching, fixing, washing and optional stabilization. Two separate steps that use a bleaching and a fixing solution individually may be replaced by a combination bleach-fix step that employs a monobath bleach-fix solution. If desired, color development, bleaching and fixing may be accomplished in one step using a combined developing, bleaching and fixing bath.

The following examples are provided for the purpose of further illustrating the present invention but are in no way to be taken as limiting.

EXAMPLE 1

The support used in Example 1 was a paper base laminated with polyethylene on one side and with $TiO_2$-containing polyethylene on the other side. A plurality of layers having the compositions formulated in Tables 1 and 2 were coated on the $TiO_2$-containing polyethylene side to prepare sample 101 of multi-layered silver halide color photographic material. The respective coating solutions were prepared as follows.

FIRST COATING SOLUTION

Yellow coupler (EY-1; 26.7 g), dye image stabilizer (ST-1; 10.0 g), dye image stabilizer (ST-2, 6.67 g) and anti-stain agent (HQ-1; 0.67 g) were dissolved in a mixture of high-boiling organic point solvent (DNP; 6.67 g) and ethyl acetate (60 ml). The resulting solution was emulsified in 220 ml of a 10% aqueous gelatin solution containing 7 ml of 20% surfactant (SU-2) by means of an ultrasonic homogenizer so as to prepare a dispersion of yellow coupler.

This dispersion was mixed with a blue-sensitive silver halide emulsion (see below: containing 8.67 g of Ag) and to the mixture, an anti-irradiation dye (AIY-1) was added, thereby yielding the first coating solution.

The second to seventh coating solutions were prepared in the same manner as the first coating solution, except that HH-1 as a hardener was added to the second and fourth layers and that HH-2 also a hardener was added to the seventh layer. As coating aids, surfactants SU-1 and SU-3 were added for surface tension adjustment.

TABLE 1

| Layer | Composition | Amount ($g/m^2$) |
|---|---|---|
| 7th protective layer | gelatin | 1.00 |
| 6th uv absorbing layer | gelatin | 0.40 |
| | uv absorber (UV-1) | 0.10 |
| | uv absorber (UV-2) | 0.04 |
| | uv absorber (UV-3) | 0.16 |
| | antistain agent (HQ-1) | 0.01 |
| 6th uv absorbing layer | DNP | 0.20 |
| | PVP | 0.03 |
| | anti-irradiation dye (AIC-1) | 0.02 |
| 5th red-sensitive layer | gelatin | 1.30 |
| | red-sensitive AgBrCl emulsion (Em-R) | 0.21 |
| | cyan coupler (EC-1) | 0.24 |
| | cyan coupler (EC-2) | 0.08 |
| | dye image stabilizer (ST-1) | 0.20 |
| | antistain agent (HQ-1) | 0.01 |
| | HBS-1 | 0.20 |
| | DOP | 0.20 |
| 4th uv absorbing layer | gelatin | 0.94 |
| | uv absorber (UV-1) | 0.28 |
| | uv absorber (UV-2) | 0.09 |
| | uv absorber (UV-3) | 0.38 |
| | antistain agent (HQ-1) | 0.03 |
| | DNP | 0.40 |

TABLE 2

| Layer | Composition | Amount ($g/m^2$) |
|---|---|---|
| 3rd green-sensitive layer | gelatin | 1.40 |
| | green-sensitive AgBrCl emulsion (Em-G) | 0.17 |
| | magenta coupler (EM-1) | 0.75* |
| | DNP | 0.20 |
| | dye image stabilizer (II-8) | 0.75* |
| | anti-irradiation dye (AIM-1) | 0.01 |
| 2nd intermediate layer | gelatin | 1.20 |
| | antistain agent (HQ-2) | 0.03 |
| | antistain agent (HQ-3) | 0.03 |
| | antistain agent (HQ-4) | 0.05 |
| | antistain agent (HQ-5) | 0.23 |
| | DIDP | 0.06 |
| | mold inhibitor (F-1) | 0.002 |
| 1st blue-sensitive layer | gelatin | 1.20 |
| | blue-sensitive AgBrCl emulsion (Em-B) | 0.26 |
| | yellow coupler (EY-1) | 0.80 |
| | dye image stabilizer (ST-1) | 0.30 |
| | dye image stabilizer (ST-2) | 0.20 |
| | antistain agent (HQ-1) | 0.02 |
| | anti-irradiation dye (AIY-1) | 0.01 |
| | DNP | 0.20 |
| Base | polyethylene laminated paper | |

*Millimole/$m^2$

The amount of addition of silver halide emulsion is indicated in terms of silver.

Shown below are the structural formulae of the compounds used in the respective layers of sample 101.

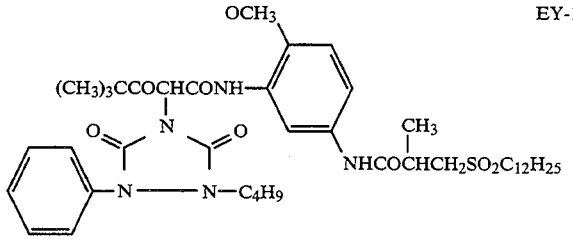

EY-1

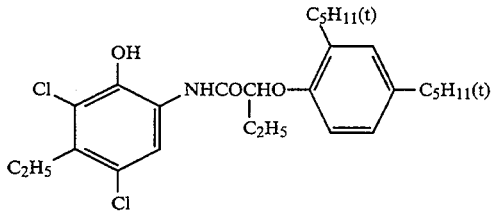

EC-1

-continued
EC-2
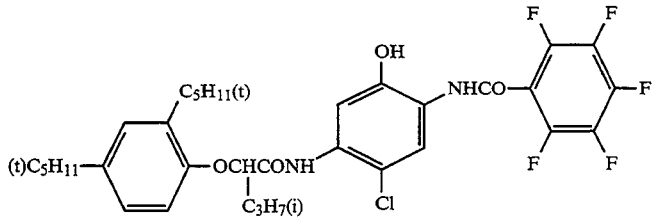
ST-1
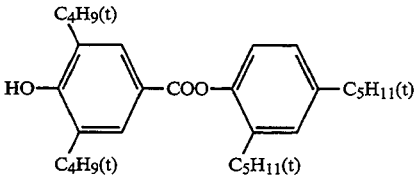
ST-2
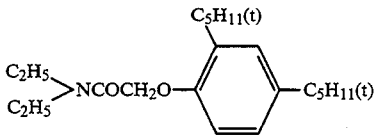
EM-1
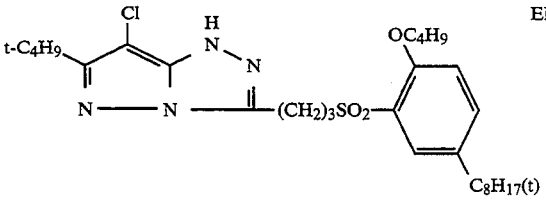
UV-1
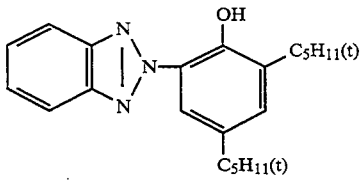
UV-2
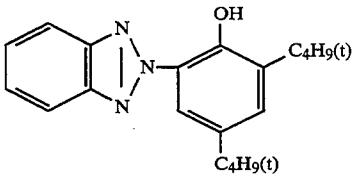
UV-3
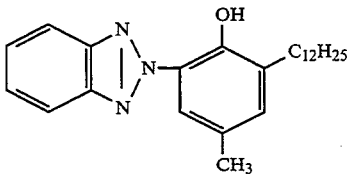
| | | | |
|---|---|---|---|
| Dioctyl phthalate | DOP | Dinonyl phthalate | DNP |
| Diisodecyl phthalate | DIDP | Polyvinylpyrrolidone | PVP |
HQ-1
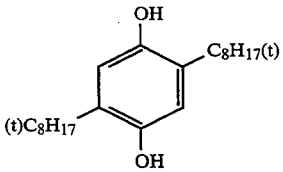
HQ-2
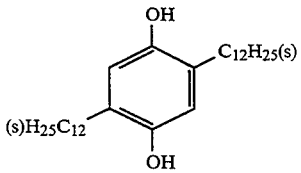
HQ-3
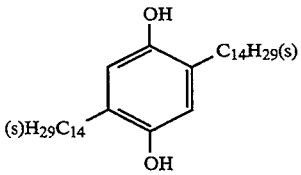
HQ-4
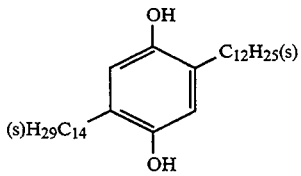
HQ-5
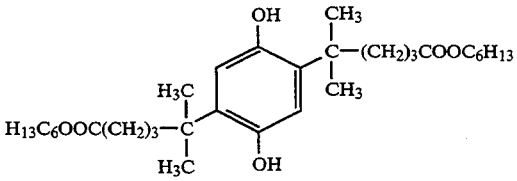
HBS-1
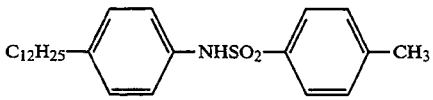
AIM-1
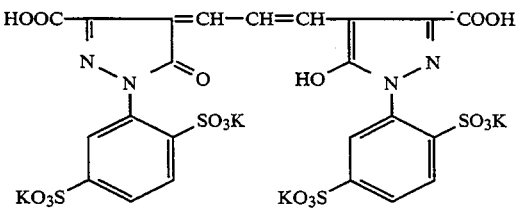

-continued

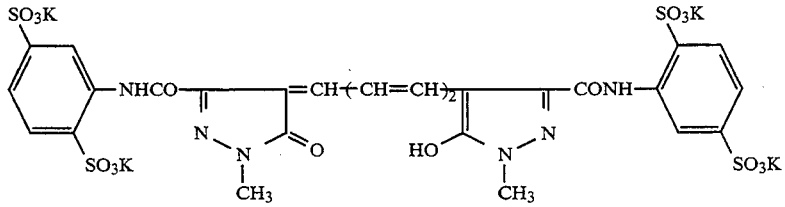

AIC-1

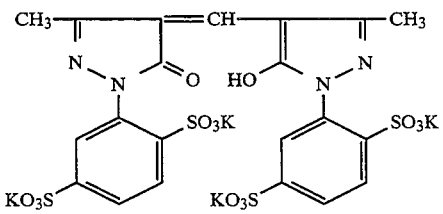

AIY-1

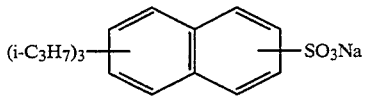

SU-1

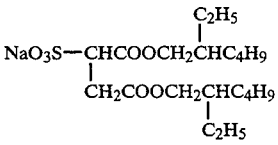

SU-2

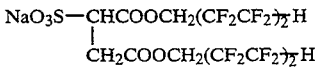

SU-3

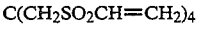

HH-1

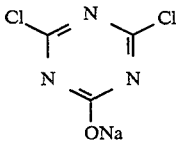

HH-2

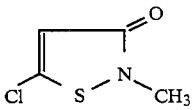

F-1

BLUE-SENSITIVE SILVER HALIDE EMULSION (EM-B)

Monodispersed cubic emulsion having an average grain size of 0.85 μm, a coefficient of variation of 0.07 and having a AgCl content of 99.5 mol %

| | |
|---|---|
| Sodium thiosulfate | 0.8 mg/mol AgX |
| Chloroauric acid | 0.5 mg/mol AgX |
| Stabilizer STAB-1 | $6 \times 10^{-4}$ mol/mol AgX |
| Sensitizer BS-1 | $4 \times 10^{-4}$ mol/mol AgX |
| Sensitizer BS-2 | $1 \times 10^{-4}$ mol/mol AgX |

GREEN-SENSITIVE SILVER HALIDE EMULSION (EM-G)

Monodispersed cubic emulsion having an average grain size of 0.43 μm, a coefficient of variation of 0.08 and having a AgCl content of 99.5 mol %

| | |
|---|---|
| Sodium thiosulfate | 1.5 mg/mol AgX |
| Chloroauric acid | 1.0 mg/mol AgX |
| Stabilizer STAB-1 | $6 \times 10^{-4}$ mol/mol AgX |
| Sensitizer GS-1 | $4 \times 10^{-4}$ mol/mol AgX |

RED-SENSITIVE SILVER HALIDE EMULSION (EM-R)

Monodispersed cubic emulsion having an average grain size of 0.50 μm, a coefficient of variation of 0.08 and having a AgCl content of 99.5 mol %

| | |
|---|---|
| Sodium thiosulfate | 1.8 mg/mol AgX |
| Chloroauric acid | 2.0 mg/mol AgX |
| Stabilizer STAB-1 | $6 \times 10^{-4}$ mol/mol AgX |
| Sensitizer RS-1 | $4 \times 10^{-4}$ mol/mol AgX |

Shown below are the structural formulae of the compounds used in the respective monodispersed cubic emulsions.

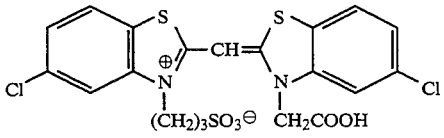

BS-1

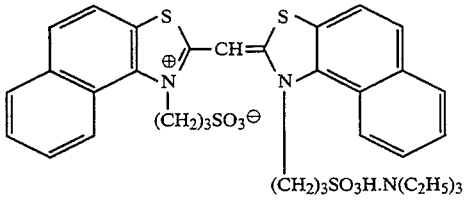

BS-2

-continued

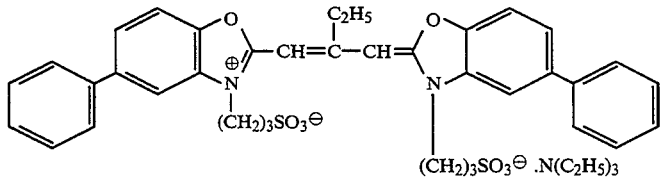

GS-1

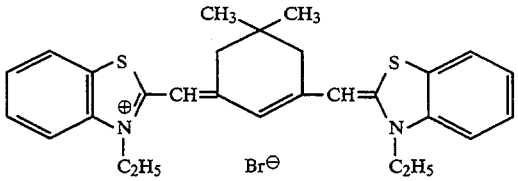

RS-1

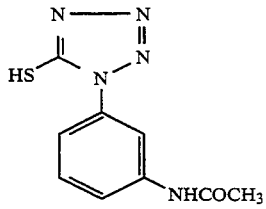

STAB-1

Samples 102–114 were prepared by repeating the procedure for the preparation of sample 101, except that coupler EM-1 in the third layer was replaced by equal moles of other magenta couplers within the scope of the present invention (see Table 3 below) or EM-2 or EM-3 (also see below).

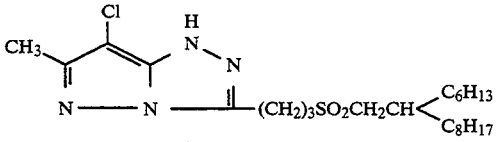

EM-2

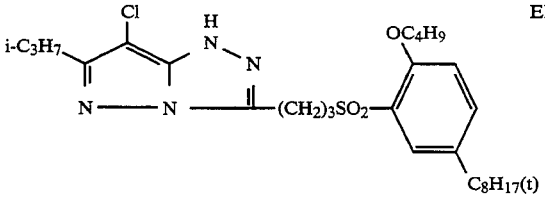

EM-3

The samples thus prepared were exposed to green light through an optical wedge in the usual manner and thereafter processed by the following scheme.

| Step | Temperature, °C. | Time, sec |
|---|---|---|
| Color development | 35.0 ± 0.3 | 45 |
| Bleach-fixing | 35.0 ± 0.5 | 45 |
| Stabilization | 30–34 | 90 |
| Drying | 60–80 | 60 |

The respective processing solutions were formulated as follows.

Each of those processing solutions was replenished in an amount of 80 ml per square meter of the silver halide color photographic material.

| Color developing solution | Tank sol. | Replenisher |
|---|---|---|
| Pure water | 800 ml | 800 ml |
| Triethanolamine | 10 g | 18 g |
| N,N-Diethylhydroxylamine | 5 g | 9 g |
| Potassium chloride | 2.4 g | |
| 1-Hydroxyethylidene-1,1-diphosphonic acid | 1.0 g | 1.8 g |
| N-ethyl-N-β-methanesulfonamidoethyl--3-methyl-4-aminoaniline sulfate | 5.4 g | 8.2 g |
| Optical brightening agent (4,4'-diaminostilbenesulfonic acid derivative) | 1.0 g | 1.8 g |
| Potassium carbonate | 27 g | 27 g |
| Water to make 1000 ml, with pH adjusted to 10.10 in the tank solution and to 10.60 in the replenisher | | |

-continued

| Bleach-fixing solution (tank solution is the same as the replenisher) | |
|---|---|
| Ethylenediaminetetraacetic acid iron (III) ammonium dihydrate | 60 g |
| Ethylenediaminetetraacetic acid | 3 g |
| Ammonium thiosulfate (70% aq. sol.) | 100 ml |
| Ammonium sulfite (40% aq. sol.) | 27.5 ml |
| Water to make 1000 ml and pH adjusted to 5.7 with potassium carbonate or glacial acetic acid | |

| Stabilizing solution (tank solution is the same as the replenisher) | |
|---|---|
| 5-Chloro-2-methyl-4-isothiazolin-3-one | 1.0 g |
| Ethylene glycol | 1.0 g |
| 1-Hydroxyethylidene-1,1-diphosphonic acid | 2.0 g |
| Ethylenediaminetetraacetic acid | 1.0 g |
| Ammonium hydroxide (20% aq. sol.) | 3.0 g |
| Optical brightening agent (4,4'-diamino-stilbenesulfonic acid derivative) | 1.5 g |
| Water to make 1000 ml and pH adjusted to 7.0 with sulfuric acid or potassium hydroxide | |

After continuous processing, the respective samples were subjected to the evaluation of the following parameters.

LIGHTFASTNESS

Each of the processed samples was exposed to a xenon fadeometer for 14 days and the percent residue of dye image for the initial density 1.0 was determined.

max

Maximum wedge absorption wavelength for the optical reflection density 1.0.

Abs600

Wedge absorbance at 600 nm for the optical reflection density at 1.0.

Dmax

Maximum color density

The results of the evaluation are shown in Table 3 below.

TABLE 3

| Sample No. | Magenta coupler in 3rd layer | λ max (nm) | Abs600 | Dmax | Residual light-fastness (%) |
|---|---|---|---|---|---|
| 101 Comparison | EM-1 | 547 | 0.42 | 1.96 | 57 |
| 102 Invention | 1 | 547 | 0.35 | 2.30 | 65 |
| 103 Invention | 6 | 548 | 0.34 | 2.49 | 62 |
| 104 Invention | 22 | 546 | 0.34 | 2.35 | 65 |
| 105 Invention | 27 | 547 | 0.35 | 2.42 | 64 |
| 106 Invention | 12 | 548 | 0.36 | 2.46 | 65 |
| 107 Invention | 36 | 547 | 0.35 | 2.39 | 67 |
| 108 Invention | 7 | 549 | 0.37 | 2.10 | 63 |
| 109 Invention | 25 | 547 | 0.36 | 2.13 | 64 |
| 110 Comparison | EM-2 | 549 | 0.32 | 2.40 | 30 |
| 111 Comparison | EM-3 | 547 | 0.37 | 2.19 | 45 |
| 112 Invention | 5 | 548 | 0.31 | 2.38 | 57 |
| 113 Invention | 9 | 549 | 0.32 | 2.48 | 55 |
| 114 Invention | 11 | 549 | 0.33 | 2.49 | 53 |

As one can see from Table 3, when samples 101–109 which used magenta couplers where the site at which the substituent in position 6 of the coupler was connected to the triazole ring was tertiary were compared with each other, samples 102–109 according to the present invention had better lightfastness and achieved more efficient color formation than comparative sample 101. Furthermore, samples 102–109 absorbed less light at 600 nm and thereby achieved better color reproduction.

When samples 110–114 which used magenta couplers where the site at which the substituent in position 6 of the coupler was connected to the triazole ring was primary or secondary were compared with each other, samples 112–114 according to the present invention were comparable in performance to samples 102–109.

EXAMPLE 2

Samples 201–214 were prepared by repeating the procedure for sample 101, except that dye image stabilizer (II-8) in the third layer was replaced by the combination of image stabilizers shown in Table 4 below and that the magenta coupler was also replaced by those which are shown in Table 4.

The samples thus prepared were subjected to the evaluation of the same parameters as tested in Example 1. The results are shown in Table 4.

TABLE 4

| Sample No. | Magenta coupler in 3rd layer | Dye image stabilizer* | λ max (nm) | Abs600 | Dmax | Residual light-fastness (%) |
|---|---|---|---|---|---|---|
| 201 Comparison | EM-1 | II-2 (1) III-2 (1,2) | 547 | 0.43 | 1.90 | 71 |
| 202 Invention | 4 | II-2 (1) III-2 (1,2) | 547 | 0.36 | 2.35 | 82 |
| 203 Invention | 14 | II-2 (1) III-2 (1,2) | 548 | 0.35 | 2.38 | 83 |
| 204 Invention | 23 | II-2 (1) III-2 (1,2) | 547 | 0.36 | 2.41 | 83 |
| 205 Invention | 33 | II-2 (1) III-2 (1,2) | 549 | 0.36 | 2.39 | 85 |
| 206 Invention | 13 | II-2 (1) III-2 (1,2) | 548 | 0.37 | 2.44 | 84 |
| 207 Invention | 24 | II-2 (1) III-2 (1,2) | 547 | 0.36 | 2.38 | 83 |
| 208 Invention | 34 | II-2 (1) III-2 (1,2) | 547 | 0.32 | 2.40 | 85 |
| 209 Invention | 18 | II-2 (1) III-2 (1,2) | 548 | 0.33 | 2.15 | 82 |
| 210 Invention | 32 | II-2 (1) III-2 (1,2) | 547 | 0.34 | 2.18 | 81 |
| 211 Comparison | EM-2 | II-2 (1) III-2 (1,2) | 549 | 0.33 | 2.38 | 33 |
| 212 Comparison | EM-3 | II-2 (1) III-2 (1,2) | 547 | 0.38 | 2.14 | 51 |
| 213 Invention | 17 | II-2 (1) III-2 (1,2) | 547 | 0.35 | 2.37 | 72 |
| 214 Invention | 19 | II-2 (1) III-2 (1,2) | 548 | 0.36 | 2.40 | 73 |

*Figures in parentheses indicate the amount of addition (millimoles/$m^2$).

As one can see from Table 4, it was demonstrated that using magenta couplers of the present invention which had substituents of the general formula [Ia] or [Ib] in position 6 of the coupler was effective in achieving significant improvements in lightfastness as well as certain improvements in color reproduction and the efficiency of color formation. Especially, it became clear that the effectiveness of the magenta couplers in improving lightfastness could be enhanced by using the combination of two dye image stabilizers represented by the general formulae [II] and [III].

Hence, it was verified that the silver halide color photographic material of the present invention exhibits good performance in terms of image keeping quality, color forming efficiency, and color reproduction.

What is claimed is:

1. A silver halide color photographic material containing at least one pyrazolotriazole base magenta coupler represented by the following general formula [Ia] or [Ib]:

[Ia]

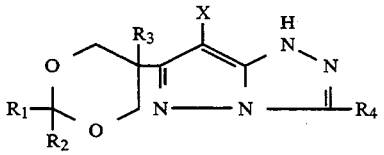

[Ib]

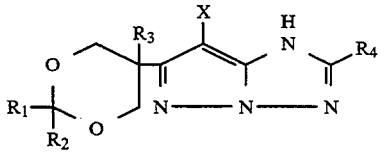

where $R_1$, $R_2$ and $R_3$ are each a hydrogen atom, an alkyl group, a cycloalkyl group or an aryl group; $R_4$ is an aliphatic or aromatic group each of which may optionally have a substitutent; X is a hydrogen atom, a chlorine atom, a bromine atom, a fluorine atom, an alkoxy group, an aryloxy group, a heterocycloxy group, an alkylthio group, an arylthio group, a heterocyclothio group, an amino group, an acylamino group, a sulfonamido group or a nitrogenous heterocyclic group bound to the pyrazolotriazole nucleus by a nitrogen atom of the heterocyclic group.

2. A silver halide color photographic material according to claim 1 wherein $R_1$ and $R_2$ are each a hydrogen atom, an alkyl group, a cycloalkyl group or an aryl group; $R_3$ is an alkyl group, an aryl group or a cycloalkyl group; $R_4$ is an aliphatic or aromatic group each of which may optionally have a substituent; X is a hydrogen atom, a chlorine atom, a bromine atom, a fluorine atom, an alkoxy group, an aryloxy group, a heterocycloxy group, an alkylthio group, an arylthio group, a heterocyclothio group, an amino group, an acylamino group, a sulfonamido group or a nitrogenous heterocyclic group bound to the pyrazolotriazole nucleus by a nitrogen atom of the heterocyclic group.

3. A silver halide color photographic material according to claim 1 which further contains at least one compound represented by the following general formula [II] or [III] in the silver halide emulsion layer containing the pyrazolotriazole base magenta coupler represented by the general formula [Ia] or [Ib]:

[II]

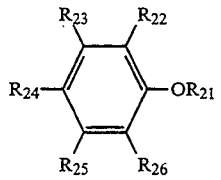

where $R_{21}$ is a hydrogen atom, an alkyl group, an aryl group, a hetrocyclic group or the following residue:

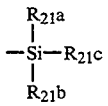

(where $R_{21}a$, $R_{21}b$ and $R_{21}c$ are each a monovalent organic group); $R_{22}$, $R_{23}$, $R_{24}$, $R_{25}$ and $R_{26}$ are each a hydrogen atom, a halogen atom or a group that can be substituted on the benzene ring, provided that $R_{21}$–$R_{26}$ may combine together to form a 5- or 6-membered ring;

[III]

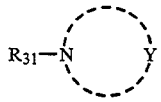

where $R_{31}$ is an aliphatic or aromatic group; and Y is the nonmetallic atomic group necessary to form a 5- to 7-membered ring together with the nitrogen atom.

4. A silver halide color photographic material according to claim 1 wherein $R_2$ and $R_3$ are each a hydrogen atom, an alkyl group having 1–20 carbon atoms, a cycloalkyl group, or a substituted or unsubstituted aryl group having 6–30 carbon atoms.

5. A silver halide color photographic material according to claim 1 wherein $R_3$ is an alkyl group having 1–20 carbon atoms, or a substituted or unsubstituted aryl group having 6–30 carbon atoms.

6. A silver halide color photographic material according to claim 1 wherein $R_4$ is an aliphatic group having 4–42 carbon atoms.

7. A silver halide color photographic material according to claim 1 wherein $R_4$ is a phenyl group.

* * * * *